United States Patent [19]

Sendzimir

[11] Patent Number: 4,497,452

[45] Date of Patent: Feb. 5, 1985

[54] TWIN COIL STRIP ACCUMULATOR

[76] Inventor: Tadeusz Sendzimir, P.O. Box 1350, Waterbury, Conn. 06721

[21] Appl. No.: 557,948

[22] Filed: Dec. 5, 1983

Related U.S. Application Data

[63] Continuation-in-part of Ser. No. 421,066, Sep. 22, 1982.

[51] Int. Cl.[3] ..... B65H 17/48; B65H 17/42; B65H 75/02

[52] U.S. Cl. ..... 242/55; 242/55.19 R; 242/78.1

[58] Field of Search ..... 242/78.1, 78.6, 78.7, 242/63, 55, 55.16, 55.17, 55.18, 55.19 R, 55.21; 226/118, 119

[56] References Cited

U.S. PATENT DOCUMENTS

| | | | |
|---|---|---|---|
| 1,602,905 | 10/1926 | Kamm | 242/55.18 |
| 2,037,601 | 4/1936 | Shirlow et al. | 242/55.19 R |
| 3,310,255 | 3/1967 | Sendzimir | 242/78.1 |
| 3,722,809 | 3/1973 | Leisring | 242/55 X |
| 3,729,144 | 4/1973 | Bijasiewicz et al. | 242/55 |
| 3,782,662 | 1/1974 | Miller | 242/55.19 R X |
| 3,885,748 | 5/1975 | Costello et al. | 242/55 |

*Primary Examiner*—Stuart S. Levy

*Assistant Examiner*—Lloyd D. Doigan

*Attorney, Agent, or Firm*—Samuel Lebowitz

[57] ABSTRACT

A variable capacity strip accumulator for steel strip travelling continuously from upstream reels of supply to a downstream treating or processing station, said accumulator having adjacent spiral coils rotatable on a common axis for accumulating a supply of the strip for continuous feeding cut of the accumulator despite a temporary stoppage of supply. In the execution of this objective, the convolutions of the two coaxial spiral coils of opposite hand are connected together by a transition curve into one continuous web. Strip guides for said curve first slightly twist the strip in the same direction as its first spiral to an extent of approximately 90°, while withdrawing it from the interior of the latter in the direction away from said coils and without substantially departing from its radius of curvature, crossing the axis at the farthest point. Continuing at the same curvature and rate of twist of 90° on its return branch, the strip reaches, and is joined to, the second coil at a point substantially antipodal to the point of departure from the first spiral and twisted by 180°. The above procedure results in the reversal of direction of winding of the convolutions of the strip in the two coils without subjecting it to any more tending than in the coils.

22 Claims, 12 Drawing Figures

TWIN COIL STRIP ACCUMULATOR

This application is a continuation-in-part of my pending application, Ser. No. 421,066, filed Sept. 22, 1982.

This invention relates to variable capacity strip accumulators and particularly in the area of such equipment which effects the transfer of the strip from the first coil to the second coil thereof.

It is the object of the present invention to improve upon the variable capacity strip accumulators known heretofore, including those disclosed in my earlier U.S. Pat. Nos. 3,310,255, Mar. 21, 1967, and U.S. Pat. No. 4,288,042, Sept. 8, 1981. In particular, the invention provides a tremendous improvement to the transition from the first to the second coil.

It is another object of the invention to improve the apparatus to make it operable at higher strip speeds.

It is still another object of the invention to provide variable capacity strip-accumulators which are rugged and economical in construction, relatively compact in size, and hence efficient in the utilization of plant floor space, and capable of handling strips of varying thicknesses ranging from mils to about one inch.

The present invention is an improvement upon applicant's abovementioned patents pertaining to transient strip accumulators with independently controllable entry and exit velocities. The strip is stored in a continuous length, in two coaxial coils of opposite hand, the transition path which the strip passes on its way from the first to the second coil being of an "S" shape to effect the change of winding direction.

This shape presents a problem, especially for thick strips, typical section $\frac{3}{4}'' \times 40''$ for welded tubes, because the radius of the "S" is only one-half of the radius of the coils and the strip must not be bent much beyond its elastic limit. Such accumulators are thus inevitably of large diameter, therefore costly and space-consuming. Applicant has solved this problem by providing a transition curve between the first and second coils which practically follows, in the first leg, the shape of the convolutions of the coils as to magnitude and direction of curvature, declining away from the coils by a slight twist, upward if the axis is vertical and sideways if it is horizontal. The path of the strip naturally follows to the intersection with the axis, at which point a 90° twist is reached, then descending in symmetry with the first leg, until at 180° twist, said path joins the second coil, having thus changed to opposite hand.

This improvement permits the reduction of the diameter of the accumulator to one-half, but also entails other advantages: (1) the speed of the strip can be increased because of the virtually constant curvature and avoidance of sudden bends, and (2) it permits the use of a much more efficient and dependable drive of the supporting rollers, especially in the vertical axis configuration where the second coil is nested within the first coil, on the same level. A single crown gear, coaxial with the coils drives all supporting rollers of one table through pinions and radial shafts, avoiding all universal joints and individual gearboxes of the prior art. Also, another advantage is the great simplification of the drive of the transition curve guide tower by simply connecting the two table drives with a differential to obtain the theoretically correct angular velocity of the tower, with the addition of a supplementary micro-drive for precise adjustment to correct for strip slippage on the supporting rails. Also, with "Related" drives: the entry pinch roll drive can be branched-off of the supporting roll drive of the first coil via a micro-adjustment drive adjustable within approximately minus 2-5% of the table supporting rolls, to compensate for strip slippage and generate a certain tension in the strip, and similarly, the exit pinch roll drive can be branched-off of the supporting roll drive of the second coil with the micro-adjustment introducing approximately minus 2-5% correction for the pinch rolls. This means that said exit pinch rolls will be driven at the same speed as the lower table rolls minus two to five percent and so exert a certain extra retardation on the exiting strip, thus preventing a gradual reduction of the diameter of the convolutions.

My earlier U.S. Pat. No. 3,310,255, discloses the stored strip in the form of two coaxial spiral coils of opposite hand whose inner wraps are joined by intermediate length of strip having a shape of the letter "S" (S-curve), which assures the change of the winding direction. The S-curve is flat and its radii are half as long as the radii of the inner diameter of the two spiral coils. Going through the S-curve, the strip must first be bent to that smaller radius in the same direction as the coil from which is exited, and then, on crossing the axis, be bent in the opposite direction. For steel strips having a modulus of elasticity $E=1/29$ million, and which have a limit of elasticity of 40,000 p.s.i. or less, the strip can be bent to a radius of curvature of no less than 1000 times the thickness of the strip. A smaller radius of curvature will cause a permanent plastic deflection, a small amount of which can be tolerated in most cases, but heavier deformations must be avoided, for they cause changes in the grain structure which affect the ductility of the strip. This becomes a serious problem in accumulators built for heavy strips, such as e.g. $0.4'' \times 18''$ strips for welded tubes which must have a very large coil diameter solely for the reason of avoiding heavy plastic deformation of the strip during its passage through the S-curve. What is worse, annealed soft steel strips will not deform uniformly, but produce kinks known as "coil breaks" which are impossible to correct by subsequent cold rolling. The problem with said S-curve is exactly the same with similar accumulators mounted on a horizontal axis, of the type disclosed in my above-mentioned U.S. Pat. No. 4,288,042.

Applicant has succeeded in eliminating the above transition curve problem by providing a substitute for said "S" curve in which the radius of curvature remains virtually the same as the one of the coils, the strip being subject to practically no flexing on its way between the first and the second coils.

Other objects and purposes, as well as new and valuable advantageous features of the invention will appear from the detailed description thereof following hereinafter, taken in conjunction with the accompanying drawings, wherein.

Figure 3A:
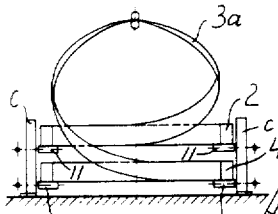
FIG. 3 shows a detail of FIG. 1.
Figure 4:
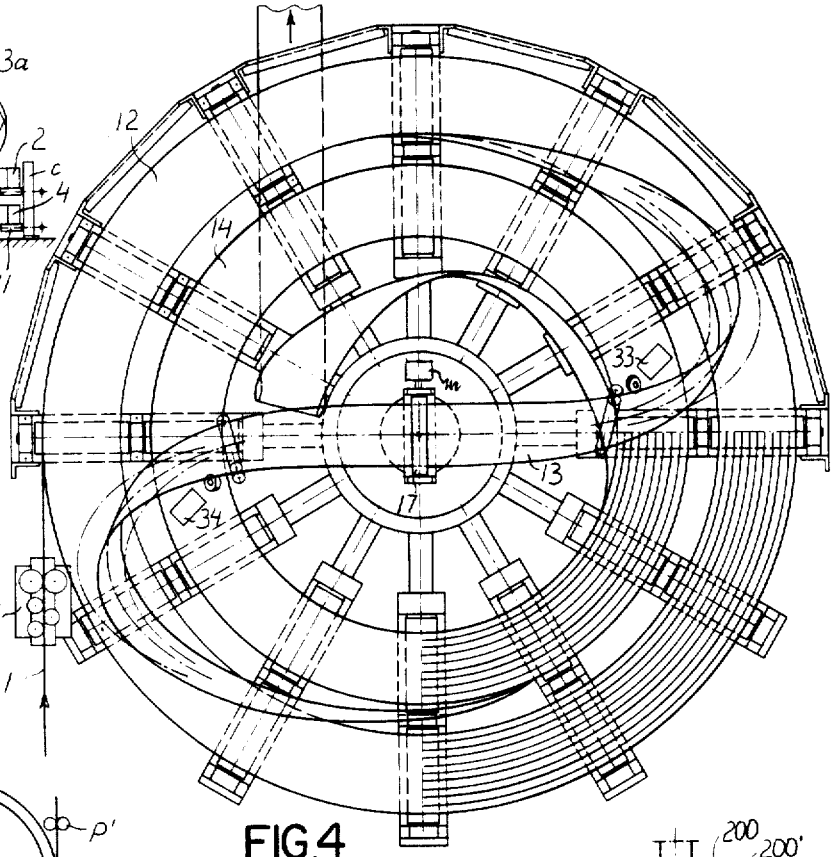
FIG.4 PRIOR ART
Figure 1:
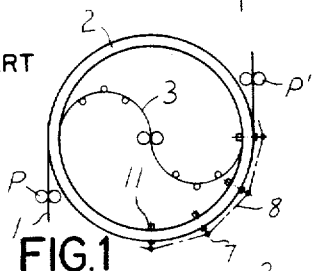
FIG. 1 is a schematic plan view of an accumulator illustrative of the prior art.
Figure 5A:
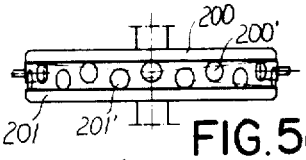
Figure 2:
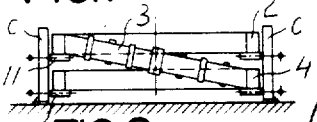
FIG.2 PRIOR ART
FIG. 2 is a schematic front elevation of FIG. 1.
Figure 3:
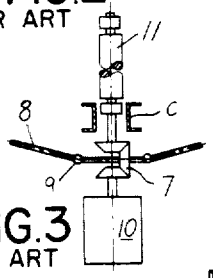
FIG.3 PRIOR ART
Figure 5:
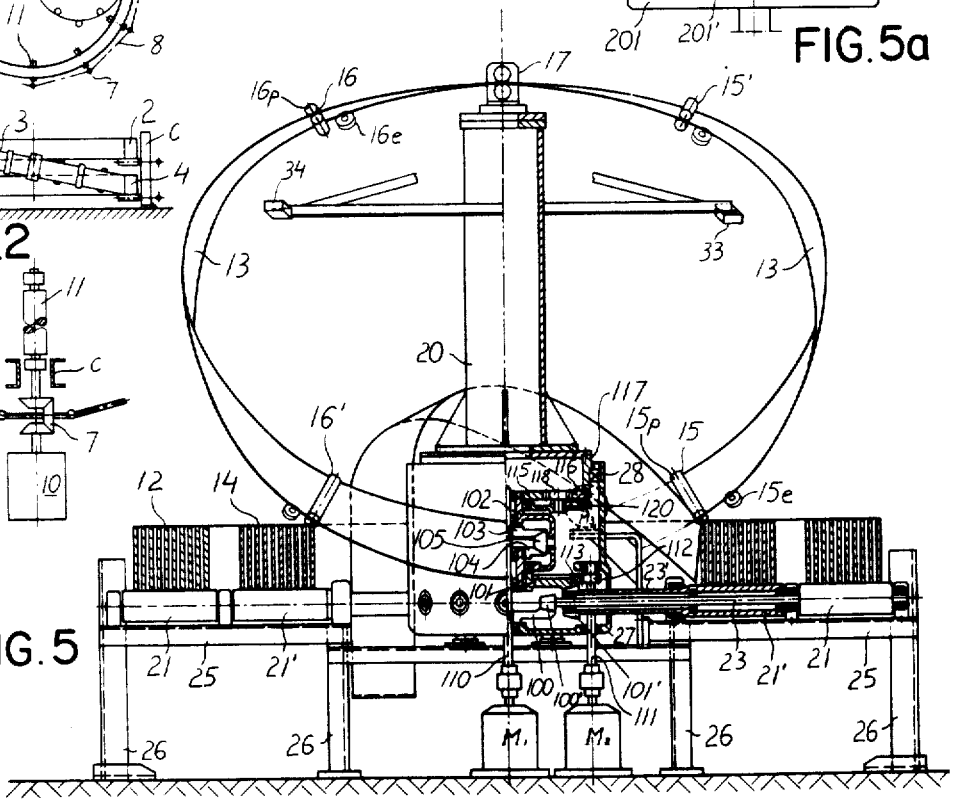
Figures 6, 7, 8, 9:
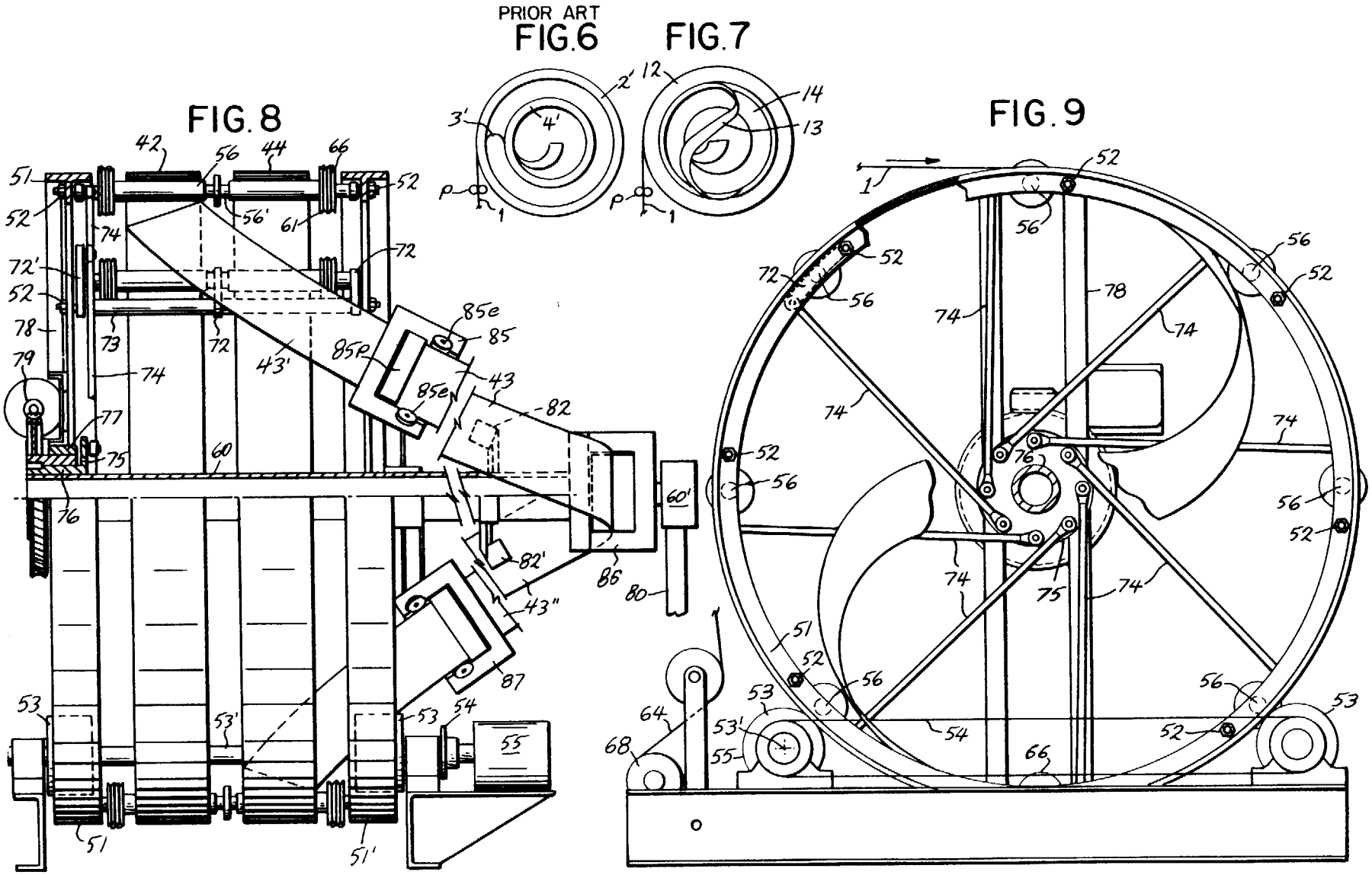
FIG. 7 PRIOR ART

FIG. 3*a* is a schematic front elevation of a modified arrangement of the accumulators shown in FIGS. 1-3, and which incorporates the instant invention;

FIG. 4 is a plan view of one embodiment of the invention showing in detail the accumulator illustrated in FIG. 7;

FIG. 5 is a front elevation, with certain parts in section, of FIG. 4;

FIG. 5*a* is a schematic elevation of an alternate drive for the spindles of the roller tables shown in the lower portion of FIG. 5;

FIG. 6 is a schematic plan view of another accumulator of the prior art, to which the instant invention may be applied;

FIG. 7 is a schematic plan view of an accumulator with two concentic coils of the type shown in FIG. 6, embodying a transition curve in accordance with the instant invention, as illustrated in detail in FIG. 4;

FIG. 8 is a vertical sectional view, with certain parts in elevation, of another embodiment of the invention applied to an accumulator operating on a horizontal axis;

FIG. 9 is an end view of FIG. 8, with certain parts in section; and

Figure 10:
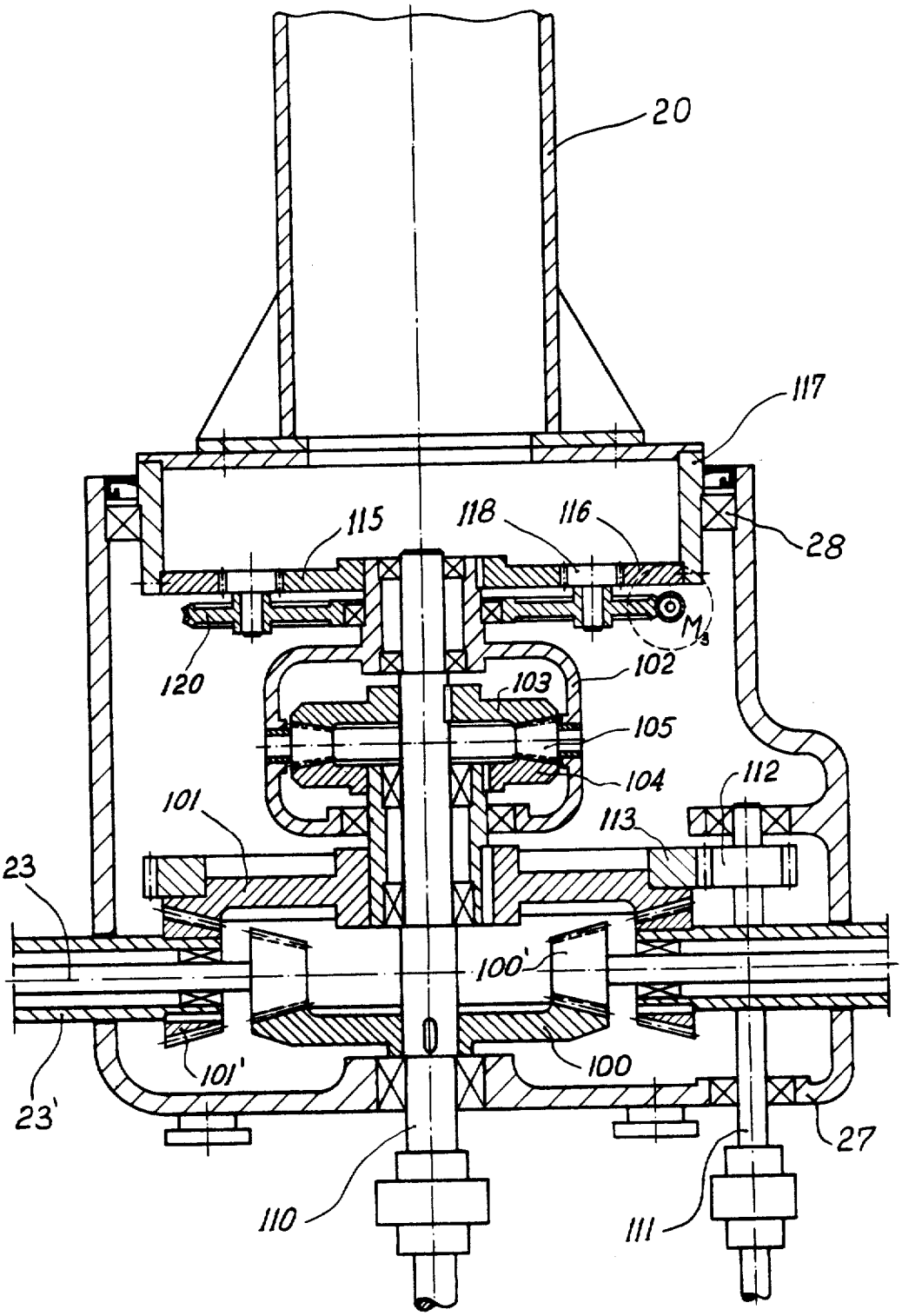

FIG. 10 is an enlarged sectional view of the lower portion of FIG. 5, showing more clearly the planetary gear drive for the supporting rollers for both coils.

In the variable capacity strip accumulator built according to the prior art, schematically shown in FIGS. 1 and 2, the steel strip 1 is first fed through entry pinch rolls P to form a right-hand spiral coil 2 of multiple wraps or convolutions. The inner wrap of said coil is then deflected to form an S-curve 3 to join the lower coil 4 while at the same time changing the winding direction from right to a left-hand spiral. Strip 1 finally leaves the accumulator from the outer wrap of coil 4 through exit pinch rolls P' and into the downstream equipment.

Coils 2 and 4 are supported and rotated by circumferentially spaced rollers 11 which receive their drive from gear boxes 7 and spindles 8 connected thereto via universal joints 9, (FIG. 3). In this way, only one motor 10 is required for coil 2 and another motor for coil 4.

FIG. 3*a* illustrates the long-radius transition curve 3*a* in accordance with the invention between the two superposed coils 2 and 4 of the accumulator shown in FIGS. 1-3, the guide means of which are described in greater detail below in conjunction with FIGS. 4 and 5.

The long-radius transition curve in accordance with the instant invention is adaptable to accumulators with two coaxial coils of opposite hand, as shown in FIGS. 1 and 2. The advantages thereof are especially marked when such transition curve is adapted to accumulators where the second coil is nested within the first, on the same level, as shown in FIG. 6 (before conversion), because of the drastically sharp reverse bend that characterizes this configuration. This adaptation of the present invention is shown in FIGS. 4, 5 and 7.

FIG. 6 shows schematically the coil arrangement with the two coils 2', 4' situated one inside the other with transition curve 3'. This is also disclosed in my above-mentioned U.S. Pat. No. 3,310,255 at FIGS. 3, 3*a* and 4, and illustrates graphically the sharp bend in the strip as it passes from the outer to the inner coil. By comparison, FIG. 7 illustrates how the herein disclosed principle is applied to such case where thetwo coaxial spiral coils are located in one plane, one inside the other. FIG. 7 shows the outer coil 12 as a right-handed spiral and its innermost convolution is shown connected to the outermost convolution of the left-handed inner coil 14 by transition curve 13 whose starting point on coil 12, and finishing point on coil 14, are preferably somewhat less than 180° apart, so that curve 13 does not pass too close to the axis which must be kept free for exit of strip 1 out of the innermost wrap of coil 14. The marked reduction in bending at the transition curve is obvious.

By comparing the two FIGS. 6 and 7, it can be seen that:

1. With the prior art, protrayed by FIG. 6, this coil arrangement is not at all suitable for heavy gauge strips, the radius of curvature being altogether too short. But even so, the space that must be left free between the two coils for the connecting curve 3' is considerable and reduces the storage capacity of the installation.

2. On the contrary, with the present invention as portrayed in FIG. 7, there is no place on the connecting curve 13 that has a radius of curvature much smaller than the radii of the coils themselves. Secondly, there is only little space, a kind of a canyon, between the two coils, needed for the said connecting curve 13 to get out and in of the spots where it connects with the coils. Thus, there is much more space left to store additional strip.

This embodiment according to the present invention is shown in more detail in FIGS. 4 and 5. Here the stored length of strip is also in the form of two coils 12 and 14, one inside the other, but the transition curve 13 which leads from the innermost convolution of the right-hand spiral 12 to the outermost convolution of the left-hand spiral 14, is in accordance with the present invention.

The new form of the transition curve of the strip is attained by simultaneously twisting the strip at its departure point from the inner wrap of coil 12 and simultaneously moving it in the axial direction away from the coils, (upwardly in this instance), while maintaining the direction and radius of curvature and progressing on this, the outward leg of the curve while continuing the twist, to reach the farthest point at its intersection with the axis at an attitude normal to it, i.e. with a 90° twist, subsequently progressing back towards the coils, following a path substantially symmetric to said outward leg, to finally reach junction with the outer wrap of the coil 14 at a point substantially antipodic to the point of departure from the first coil and after having reached a 180° twist.

This guiding in an upward direction and gradual twisting of the strip 90° from the "on edge" position in the coil is controlled by sets of rollers 15 and 15' mounted at different levels of the framework of the rotatable tower 20 and which, as shown in FIG. 5, is supported by the central column 20 extending from the base of the machine, coaxially with the rolling supports for spiral coils 12 and 14. The pair of rollers 17 is mounted at the top of column 20 for guiding the strip at the peak of the transition curve following the completion of the 90° twist. Thereafter, the strip is led downwardly by guide rollers 16 and 16', substantially symmetrically to the upward travel thereof, at the same rate as the first twist imparted by rollers 15 and 15'. Each of the sets of guide rollers 15, 15', and 16, 16' are composed of pinch rollers 15*p*, 16*p* and grooved edge rollers 15*e*, 16*e*. When the strip reaches the level of the inner spiral coil 14 to join the outermost convolution thereof, it has completed the transition curve and reversed the winding direction while following the same radius of curvature as both the incoming and outgoing spiral coils.

Thus, the purpose of joining the inner wrap of the first with the outer wrap of the second, opposite-hand spiral coil has been accomplished while: (1) not departing much from the radius of the coil itself and not changing the direction of curvature, and (2) although the second spiral is of opposite hand, there is no change in the direction of curvature, as can be seen by carefully looking at the figures.

Suppose the strip is painted, one face red and the other blue, then in the prior art accumulator of FIGS. 1 and 2, the upper coil will appear blue and the lower red (or vice versa). But not so on the accumulator of the present invention (FIG. 4); here both coils will appear the same color.

The curve shown in FIG. 5 of applicant's U.S. Pat. No. 3,310,255, (described at column 6, lines 50 to 68), might appear at first sight, similar to the transition curve of the present invention, and in anticipation of a possible misunderstanding, applicant explains as follows:

The catenary section has a large radius and is situated outside of the two coils, just like applicant's new "transition curve" that is to replace the "S" curve of the earlier patent. But in FIG. 5 of the patent, it does not replace the "S" curve: the two halves of it are situated between the inner wraps or convolutions of each coil and the two ends of the catenary section. Said catenary would not help in reducing dimensions of an accumulator for thick strip, such as $\frac{3}{4}''\times 40''$ section mentioned above, because the two portions of the "S" curve having a small radius are still there; see FIG. 5. And neither could a person skilled in the art learn therefrom either the problem which applicant has solved or its solution. By definition, applicant's transition curve can exist only in conjunction with two coaxial coils of opposite hand.

In the previously mentioned U.S. Pat. No. 3,310,255, applicant discloses also two major applications of the spiral looper:

1. For feeding continuous processing lines (FIG. 6 column 6, line 69, to column 7, line 26, and column 8, lines 47 to 57), the operation being completed in one pass through such line, at uninterrupted constant speed. FIG. 6 shows a 4-stand tamdem cold strip mill and the description mentions also other processes such as annealing, hot metal coating, cleaning, degreasing, etc.

2. Where the process requires several passes through the same rolling mill or instrumentality. Shown in FIG. 7 (and described at column 7, line 27 to column 8, line 46 and lines 57 to 67), is a method of cold-rolling a strip in an endless or closed loop, in several passes, at the end of which it may be several times longer, the spiral looper taking up such increased length.

At lines 57 to 67 of column 8, is described another application, such as coating (painting, metal coating), which mentions that for such purpose it may be advantageous to apply the so-called "Moebius effect" where the loop is closed after having been twisted 180°. The advantage would be that the coating instrumentality may be applied to one side of the strip only and the strip would be passed twice resulting in both sides being coated. (This is a well-known topological effect: the Moebius strip has only one side).

This explanation is deemed to be necessary, because the Moebius effect makes a closed loop of a strip which involves one 180° twist in it, whereas applicant's "long radius transition curve" also requires a 180° twist, but in an open coil, and permits to effect the transition from coil #1 to coil #2 in a long-radius curve, being thus the only known alternative to the "S" curve of said U.S. Pat. No. 3,310,255.

It can be appreciated that applicant's solution accomplishes much more than has been attempted in the first place. Not only has the radius of curvature been lengthened but the reverse curvature has been eliminated. Actually, once the strip is guided into the first spiral coil, it continues on its way through the accumulator with virtually unchanged curvature.

The result is a reduction to one-half of the diameter of the coil permissible for a given maximum strip guage, compared to prior art, a cost savings. Secondly, since the new curve 13 is situated outside and not inside the two coils, the inside space now becomes free, so that the supporting rollers 21, 21' of each coil can now be driven from inside, each roller directly connected to one crown gear 100,101 and not by the cumbersome drive from outside, as shown in prior art FIGS. 1 and 2.

FIGS. 4 and 5 show the embodiment schematically shown in FIG. 7 with the necessary details. The plane of the strip at the summit of the transition curve, at rollers 17, is perpendicular to the axis of the coils. The outer coil 12 and the inner coil 14 are supported by radially extending rollers 21 and 21' whose bearings are mounted on beams 25 supported at both ends by stanchions 26 to provide sufficient distance from the floor for guiding the strip out of the inner convolution of coil 14 out of the accumulator and towards the downstream processing equipment. Twelve sets of rollers 21,21' are shown, but the number, usually between six and twenty-four, will depend on the size of the equipment, thickness of the strip, and other factors.

The present arrangement where two coaxial coils of opposite hand are disposed, one inside the other on the same level, has permitted the development of a combined drive for the supporting rollers and the tower to accomplish this.

Spindles 23 of supporting rollers 21, (FIGS. 5 and 10), terminating in pinions 100' are in mesh with crown gear 100 keyed unto shaft 110 of motor reducer M1. Hollow spindles 23' of supporting rollers 21', whose pinions 101', are in mesh with crown gear 101 are driven by motor reducer M2 whose shaft 111 has pinion 112 keyed unto its end. The latter is in mesh with gear 113 rigidly secured to said crown gear 101. The crown gears and pinions in engagement therewith are disposed in a stationary housing 27 at the center of the frame.

During the operation of attaching a new coil of strip upstream of said accumulator, the strip entry velocity is of course zero, while the exit velocity to the downstream processing equipment must remain constant, i.e., the accumulator is being emptied. During that period, when one convolution is removed from coil 14, another one convolution is removed from coil 12 and this is accomplished by one full revolution of the transition curve 13 which is supported by tower 20. Consequently, the tower must be rotated at half the angular velocity of the coil from which the strip is beling removed, as long as the other coil does not rotate. Likewise, if the entry and exit velocities of the strip are equal, the angular velocity of the tower 20 is zero.

Applicant has succeeded in providing this basic tower drive, and on top of it, a micro-adjustment to compensate for eventual slippage of the strip upon the supporting rollers, by intalling a rotating differential gear-box 102 coaxially above said supporting roller drive; with its pinions 103 and 104 connected by keyed shafts with said two crown gears 100 and 101, respectively. The satellite pinions 105 and the differential box 102 are geared to drive or rotate the tower 20 through the intermediary of a planetary differential train of gears consisting of the gear 115 mounted on said box 102 of the first-mentioned differential, the internal tooth gear 116 of said micro-drive differential mounted in box 117 serving as a base for tower 20 and rotatably mounted on the same axis.

The free member of said planetary micro-drive differential is the group of satellite pinions 118 meshing with both gears 115 and 116, whose axes are located in bushings provided in the web of worm gear 120, which is rotatably mounted on box 102 of said first differential. As long as the worm gear 120 is stationary, tower 20 rotates at one-half the difference of the angular velocities of the rotating accumulator coils 12 and 14, which is the theoretically correct velocity as was explained above. But a rotation of said worm gear 120 effected by the independent motor-reducer M3 through a worm mounted upon its shaft permits the alteration of that velocity by small increments, either to add or deduct from said basic velocity to compensate for strip slippage on its supporting rolls.

All of the above-mentioned elements are affixed to the tower 20. Said tower is rotatably mounted on the fixed base 27 and rotates on a combined double thrust and radial bearing 28, coaxial with the coils 12,14.

FIG. 5*a* is a schematic view of an alternate drive for the spindles 23,23' of the two roller tables, where the hollow rollers 21' of the inner table are avoided.

In this embodiment, both crown gears 200 and 201 can be of the same diameter, but the driven pinions 200', 201' are smaller, so as to provide room for, in the instance, all twenty-four of them around the periphery of the crown gears, with the teeth of the adjacent pinions clearing each other. As can be seen from the figure, the level of the spindles of the outer table is lower than the spindles of the inner table by the height of the teeth, which is insignificant. Yet I prefer to raise the spindles of the outer table by a small angle, so that their inner ends are on the same level as the rollers of the inner table and therefore, their outer ends a fraction of an inch higher, which is desirable, this being the first coil where a slight slope tends to loosen it and prevents a self-locking condition. Power drive can be supplied to both crown gears, just like in the preceding embodiment, or it can be applied directly to at least one roller of each table, the teeth of the pinions being adequately strong to drive the remaining eleven pinions via the crown gear, for such relatively light drive.

For control of the speed of the strip in transition curve 13, proximity gauges or equivalent are provided; 33 on the rising branch and 34 on the descending branch. The control by these gauges holds the shape of the curve within the dotted lines in FIG. 4, indicating the centerline of the strip. When the ascending branch becomes too long, motor m driving the summit pinch rollers 17 is speeded up. When the descending branch of curve 13 becomes too long, adjustable speed motor M3, which controls rotation of the tower 20 is rotating clockwise or counterclockwise to correct it, depending upon whether the accumulator is being filled or emptied.

The proximity gauges 33 and 34 are well known instruments in the industrial arts. I have found Reel Control Model PC 251, marketed by Gordon Products, Inc. of Brookfield, Conn., highly practical. This model is designed to automatically maintain a predetermined amount of slack between either a stock feeding reel or a stock take-up reel and a processing machine. This device has no moving parts, and a stationary sensor creates a sensing field which is traversed by the strip to generate a control voltage when the strip diverges from a predetermined trajectory relative to the sensor. This control voltage is imposed on the electric motor which controls the feed on the strip to bring it back to its proper course.

The accumulator shown in FIGS. 8 and 9 differs from the one shown in FIGS. 4 and 5 in that its axis is horizontal rather than vertical which is a matter of choice. My U.S. Pat. No. 4,288,042 illustrates such designs and FIGS. 8 and 9 are an improvement compared with it.

The upstream coil unwinding equipment and the downstream processing equipment are, as a rule, built for strip being in a horizontal position, so in cases where "twist" sections are objectionable, such a horizontal-axis accumulator is preferred.

Coils 42 and 44 of strip 1 are carried by a cage consisting of two rotors 51,51' joined together by distance or spacing rods 52. Said rotors are supported and driven by a pair of wheels 53, each two joined by an axle 53'. The two axles are connected by chain and sprockets 54 and are jointly driven by gearmotor 55.

There are eight coil-supporting rollers 56 for each coil. They are disposed, evenly spaced, around the circumference of the cage. They are mounted on stationary shafts 56', there being two rollers for each shaft: the one on the left for coil 42 and the one on the right for coil 44. A pulley 61 is provided on each roller to cause rotation of said coils or to retard such rotation. For this purpose, pulley 68 is provided whose belt 64 engages pulleys 66 around more than half of the periphery which suffices to control forces acting on said coil. The other coil has a similar drive independent of the first.

The mounting of each shaft 56' is such as to permit control of the distance of its axis from the axis of the cage, as the internal diameter of the coils increases or decreases. For this purpose, said shafts are supported at both ends and in the center by links 72 which are keyed unto a rigid tube 73 fulcrumed on the above-mentioned spacing rods 52. In order to alter the distance of all eight roller shafts 56 from the central axis, said links 72 are caused to change their angular position which is effected by connecting them by rods 74 with eight pins disposed around the periphery of flange 75 mounted on hollow shaft 76. The latter is rotatably located in bearing block 77 held in the central axis by supports 78. A wormgear drive 79, mounted at the other end of shaft 76, is provided to control the angular position of flange 75. The link 72', situated at the left-hand end of each shaft 56' is extended to become a lever for connection rod 74 with the corresponding pin or flange 75.

The above mechanism is provided on one (left-hand) end of the apparatus only.

Tube 60 is mounted in the bore of said shaft 76, whereas its opposite end is supported by bearing 60' held in its position in the central axis by pedestal 80. It serves as a base on which to mount the several guiding means for the connecting transition section of strip 1, in the form of curve 43, to join the strip of coils 42 and 44 in one continuous web. They consist preferably of grooved edge rolls 85*e* and pinch rolls 85*p* mounted on a support 85 therefor, disposed along the path of the curved strip on the outgoing leg 43', grooved edge rolls and pinch rolls on support 86 mounted at the extreme end as a gate in tube 60, and grooved edge rolls and pinch rolls on a support 87 on the returning leg 43''.

Similar to those of FIGS. 4 and 5, proximity gauges 82 and 82' are provided to keep the curvature of strip 1 between the outer pinch rolls on support 86 and the closest guides 85 and 87 within permissible limits, by controlling both the strip propelling and the cage rotating motors.

In operation, the strip 1 coming from an unwinding reel (not shown), enters the outer convolution of coil 42. Upon reaching the inner convolution of the spiral it is guided into the connecting curve 43 and then back to join the inner convolution of coil 44, then following that spiral, leaving the outer convolution of coil 44, usually via exit pinch rolls, to the downstream processing equipment. When the entering strip is stopped, as for joining the next coil after the end of the preceding one, while the exit velocity remains the same, the accumulator is gradually depleted, as the inner wraps are pulled out while the cage and together with it, the connecting curve 43 are rotating at half the velocity, i.e. one revolution of curve 43 for withdrawal of one convolution of each of the two coils.

As the inner wraps are removed, always symmetrically, one from each coil, so does the internal diameter of the two coils increase. Therefore, to assure contact of the supporting rollers 56 with the internal diameter of the coils, flange 75 is rotated and the rods 74 turn all levers 72' and so increase the diameter of the circle circumscribed over the supporting rollers. The reverse happens when the accumulator is filled with more strip, i.e., when the speed of the entering strip is higher than the speed of strip exiting from the accumulator.

The embodiments of FIGS. 8 and 9, as well as those of FIGS. 4 and 5, show a valuable feature for wide strips, even if they are not very thick. Reference to FIGS. 1 and 2 shows that for very wide strips, such as 60" strips for auto bodies, the wide angle of descent of the S-curve becomes very steep for a given coil diameter. Present practice permits angles up to about 10°. This imposes an enormous diameter for the coils of such width. For example, an accumulator for storing 8000 feet of 60" wide strip, 0.125 to 0.020 inches in thickness, could have coils of an outer diameter of twenty-five feet, but for 8000 feet of strip, this would result in a 14° descending angle of the S-curve. With the present invention there is no such limitation, because the transition curve of strip is guided completely out of the space between the two coils. Furthermore, the cost of an accumulator having an outer diameter of twenty-five feet is less than one-half of the cost of an accumulator having an outer diameter of thirty feet, as would be required by the accumulators of the prior art.

I claim:

1. An apparatus for storing a variable uninterrupted length of forwardly advancing strip material disposed in two adjacent coaxial spiral coils, each of multiple turns between the innermost and outermost convolutions, and with the convolutions thereof coursing in opposite directions, with transition curve between the coils for effecting the reversal of the direction of the convolutions, comprising (a) guide means for withdrawing the innermost convolution of the first spiral coil in the direction away from both coils and substantially beyond the space inside said coils into a large transition curve of substantially the same radius of curvature as said convolutions, while simultaneously and gradually imparting thereto a twist of approximately 90°, at the farthest point, (b) return guide means for the strip to follow a course roughly symmetrical to said outward course i.e., while imparting an additional 90° twist for joining the latter with the second coil at a point substantially antipodal to the point of departure of said strip from the first coil wherein the strip is bent at a curvature comparable to that of the radius of said coils, and (c) said guide means comprising a plurality of cylindrical bodies for controlling the free transport of the strip through the transition curve with no more than tangential contact of the strip with said bodies.

2. An apparatus as set forth in claim 1, including additional guide means at the peak of said transition curve beyond said first-mentioned guide means for confining the strip in a plane perpendicular to the axis of the coils.

3. An apparatus as set forth in claim 2, wherein said guide means for the strip through said transition curve comprises pairs of guide rolls engaging both faces of the strip, at least some of them provided with drive mens for controlling the degree of twist as well as the longitudinal travel of said strip.

4. An apparatus as set forth in claim 3, including grooved rollers adapted to contact the edges of said strip.

5. Apparatus according to claim 3, including a rotary structure coaxial with said coils to which are attached the supporting rollers for both coils, said structure extending in the direction of said transition curve for support of all guide means of the latter.

6. An apparatus as set forth in claim 5, including drive means for at least one pair of said guide rolls for controlling the longitudinal travel of said strip, said drive means being mounted at the outer end of said rotary structure.

7. An apparatus as set forth in claim 3, including drive means mounted at the outer end of said rotary structure for controlling the guide rolls of the guide means at the peak of the transition curve, and proximity gauges adjacent to the strip in the transition curve in advance and beyond the peak of the curve for controlling the drive means to automatically restore the position of the strip in response to deviation from its normal course.

8. An apparatus as set forth in claim 2, wherein the return guide means feeds the strip into the innermost convolution of the second spiral coil.

9. An apparatus as set forth in claim 8, wherein the first and second coils are of substantially the same diameter, and disposed in superposed horizontal planes, for operation on a common vertical axis, with said guide means thereabove.

10. An apparatus as set forth in claim 9, including a rotary tower structure coaxial with the coils extending upwardly therefrom, an annular frame with equidistantly disposed radial supporting rollers supporting each of said coils on edge, and means for actuating said rollers in each annular frame in opposite rotary directions.

11. An apparatus as set forth in claim 8, wherein the first and second coils are of substantially the same diameter, and disposed in closely adjacent vertical planes for operation on a common horizontal axis, with said guiding means positioned laterally therefrom and beyond both coils.

12. An apparatus as set forth in claim 11, including a rotary cage on said horizontal axis for supporting said spiral coils, comprising (a) a pair of parallel laterally-displaced rotors connected by a plurality of parallel circumferentially spaced rigid distance rods extending therebetween, (b) means for supporting and rotating said rotary cage, (c) two sets of rotating rollers for supporting and propelling strip material in spiral coil form, one set for the first spiral coil and the other set for the second spiral coil, and (d) means for adjusting the radial spacing of said last-mentioned rollers from said horizontal axis in response to the varying internal diameter of said coils due to the relative accumulation and withdrawal of said strip material on said spiral coils.

13. An apparatus as set forth in claim 12, including drive means for actuating said rotating rollers to advance or retard the movement of the strip in contact therewith.

14. An apparatus as set forth in claim 12 in which the coil supporting rollers are mounted on parallel stationary shafts evenly spaced around the periphery of said cage, two on each shaft, one for the left and the other for the right-hand coil, said shafts being supported at both ends and in the center by three links, the opposite ends of which are keyed on to a rigid tube which in turn is rotatably mounted upon said distance rods to form rigid yokes, one for each pair of rollers, and means to control the angular position of all said yokes evenly, in order to insure contact of said supporting rollers with the internal diameter of the coils, the latter varying as the accumulator is being filled or emptied.

15. An apparatus as set forth in claim 14, wherein the end of each distance rod connected to its yoke is in turn connected to a flange axially mounted in said rotary cage and means for controlling its angular position on said flange in response to the accumulation of convolutions of the strip on the incoming and outgoing spiral coils.

16. An appararus as set forth in claim 1, wherein the return guide means feeds the strip into the outermost convolution of the second spiral coil for ultimate withdrawal from the interior of the latter.

17. An apparatus as set forth in claim 16, wherein the first and second spiral coils are concentric, with the latter positioned within the former.

18. An apparatus as set forth in claim 17, including a frame for supporting said coils, comprising (a) an outer annular set of equidistantly radially disposed rollers for supporting the first coil on edge, (b) an inner annular set of equidistantly radially disposed rollers for supporting the second coil on edge, and (c) drive means for actuating the rollers of each annular set in opposite rotary directions, each of said drives consisting of a central crown gear in engagement with circumferentially spaced pinions, each connected by a shaft with one of said supporting rollers.

19. An apparatus as set forth in claim 16, wherein the point of departure of said strip from said first coil and point of entry into the second coil are slightly displaced from their antipodal relation to make room for the strip exiting from the interior of the last-mentioned coil.

20. An apparatus for storing a variable uninterrupted length of forwardly advancing strip material disposed in two adjacent concentric coaxial spiral coils, each of multiple turns between the innermost and outermost convolutions, and with the convolutions thereof coursing in opposite directions, with transition curve between the coils for effecting the reversal of the direction of the convolutions, comprising (a) guide means for withdrawing the innermost convolution of the first outer spiral coil in the direction away from both coils and substantially beyond the space inside said coils into a large transition curve of substantially the same radius of curvature as said convolutions, while simultaneously and gradually imparting thereto a twist of approximately 90°, at the farthest point, (b) return guide means for the strip to follow a course roughly symmetrical to said outward cource i.e., while imparting an additional 90° twist for joining the latter with the outermost convolution of the second inner coil within said first coil, at a point substantially antipodal to the point of departure of said strip from the first coil for ultimate withdrawal from the interior of the second coil, (c) a frame for supporting said coils, comprising (d) an outer annular set of equidistantly radially disposed rollers for supporting the first coil on edge, (e) an inner annular set of equidistantly radially disposed rollers for supporting the second coil on edge, (f) drive means for actuating the rollers of each annular set in opposite rotary directions, each of said drives consisting of a central crown gear in engagement with circumferentially spaced pinions, each connected by a shaft with one of said supporting rollers, and (g) a rotary tower structure for supporting the transition curve between the coils and differential transmission means, the free member of which is connected to said rotary tower structure.

21. An apparatus as set forth in claim 20, wherein said central crown gears are of identical size facing each other, with said spaced pinions being arranged in two groups, the pinions of each group alternating with each other circumferentially as well as in elevation for engagement with only one of said crown gears to drive the supporting rollers for each of the coils in opposite directions.

22. An apparatus for storing a variable uninterrupted length of forwardly advancing strip material disposed in two adjacent coaxial spiral coils, each of multiple turns between the innermost and outermost convolutions and with the convolutions thereof coursing in opposite directions, with transition curve between the coils for effecting the reversal of the direction of the convolutions, comprising (a) guide means for withdrawing the innermost convolution of the first spiral coil in the direction away from both coils and substantially beyond the space inside said coils into a large transition curve of substantially the same radius of curvature as said convolutions, while simultaneously and gradually imparting thereto a twist of approximately 90°, at the farthest point, including additional guide means at said point for confining the strip in a plane perpendicular to the axis of the coils, (b) return guide means for the strip to follow a course roughly symmetrical to said outward course i.e., while imparting an additional 90° twist for joining the latter with the second coil at a point substantially antipodal to the point of departure of said strip from the first coil, (c) said guide means for the strip through said transition curve comprising pairs of guide rolls engaging both faces of the strip, at least some of them provided with drive means for controlling the degree of twist as well as the longitudinal travel of said strip, and (d) a rotary structure coaxial with said coils to which are attached the supporting rollers for both coils, said structure extending in the direction of said transition curve for support of all guide means of the latter, (e) said drive means for controlling the longitudinal travel of the strip being mounted at said point at the outer end of said rotary structure, (f) said supporting rollers for the coils, comprising an outer annular set of equidistantly radially disposed rollers for supporting the first coil on edge, (g) an inner annular set of equidistantly radially disposed rollers for supporting the second soil on edge, (h) drive means for actuating the rollers of each annular set in opposite rotary directions, (i) an adjustable speed motor connected to said rotary structure, and (j) differential transmission means cooperating with said drive means, the free member of which is actuated by said motor to correct for slippage of the strip on the supporting rollers.

* * * * *

UNITED STATES PATENT AND TRADEMARK OFFICE

CERTIFICATE OF CORRECTION

PATENT NO. : 4,497,452

DATED : February 5, 1985

INVENTOR(S) : TADEUSZ SENDZIMIR

It is certified that error appears in the above-identified patent and that said Letters Patent is hereby corrected as shown below:

On the cover page, in the Abstract, line 6, "cut" should read --out--; in the last line, "tending" should read --bending--.

Column 5, line 28, "two coaxial coils of opposite hand" should read --two coaxial coils of opposite hand--.

Column 10, line 17, "mens" should read --means--.

Column 12, line 10, "cource" should read --course--.

Column 12, line 30, "coils and" should read --coils, and--.

Signed and Sealed this

*Sixth* Day of *August 1985*

[SEAL]

*Attest:*

DONALD J. QUIGG

*Attesting Officer* *Acting Commissioner of Patents and Trademarks*